United States Patent [19]

Willoughby

[11] Patent Number: 5,012,558

[45] Date of Patent: May 7, 1991

[54] REUSEABLE, MULTI-PURPOSE, EASY RELEASE PRESSURE BAND

[76] Inventor: Henry D. Willoughby, 331 Long Dr., Pittsburgh, Pa. 15241

[21] Appl. No.: 475,346

[22] Filed: Feb. 5, 1990

[51] Int. Cl.[5] ..... B65D 63/00

[52] U.S. Cl. ..... 24/16 PB; 24/17 AP

[58] Field of Search ..... 24/16 PB, 17 AP, 17 A, 24/17 B, 300, 301, 30.5 P; 606/157; 128/77

[56] References Cited

U.S. PATENT DOCUMENTS

| | | | |
|---|---|---|---|
| 1,945,932 | 2/1934 | Caley | 24/17 AP |
| 2,004,702 | 6/1935 | Luttmann, Jr. | 24/300 |
| 2,961,785 | 11/1960 | Toepfer | 24/16 PB |
| 2,977,145 | 3/1961 | Rifkin | 24/16 PB |
| 3,224,054 | 12/1965 | Lige | 24/16 PB |
| 3,468,050 | 9/1969 | Pool | 24/16 PB |
| 4,037,603 | 7/1977 | Wendorff | 606/157 |
| 4,403,375 | 9/1983 | Blum | 24/16 PB |

FOREIGN PATENT DOCUMENTS

| | | | |
|---|---|---|---|
| 796222 | 4/1936 | France | 24/17 AP |
| 1086297 | 2/1955 | France | 24/16 PB |
| 667640 | 9/1964 | Italy | 24/16 PB |
| 227423 | 5/1969 | U.S.S.R. | 24/16 PB |
| 698696 | 10/1953 | United Kingdom | 24/17 AP |
| 1108514 | 4/1968 | United Kingdom | 24/16 PB |

*Primary Examiner*—Victor N. Sakran

*Attorney, Agent, or Firm*—William J. Ruano

[57] ABSTRACT

A band for wrapping tightly about an object in self-fastened relationship thereto. The band comprises a flat strip of elastic material having a tail end and an arrow shaped head end terminating in a neck portion. A hole is provided adjacent the tail end of a size to enable the arrow shaped head to be extended therethrough when said tail end is stretched longitudinally.

4 Claims, 7 Drawing Sheets

FIG. 5
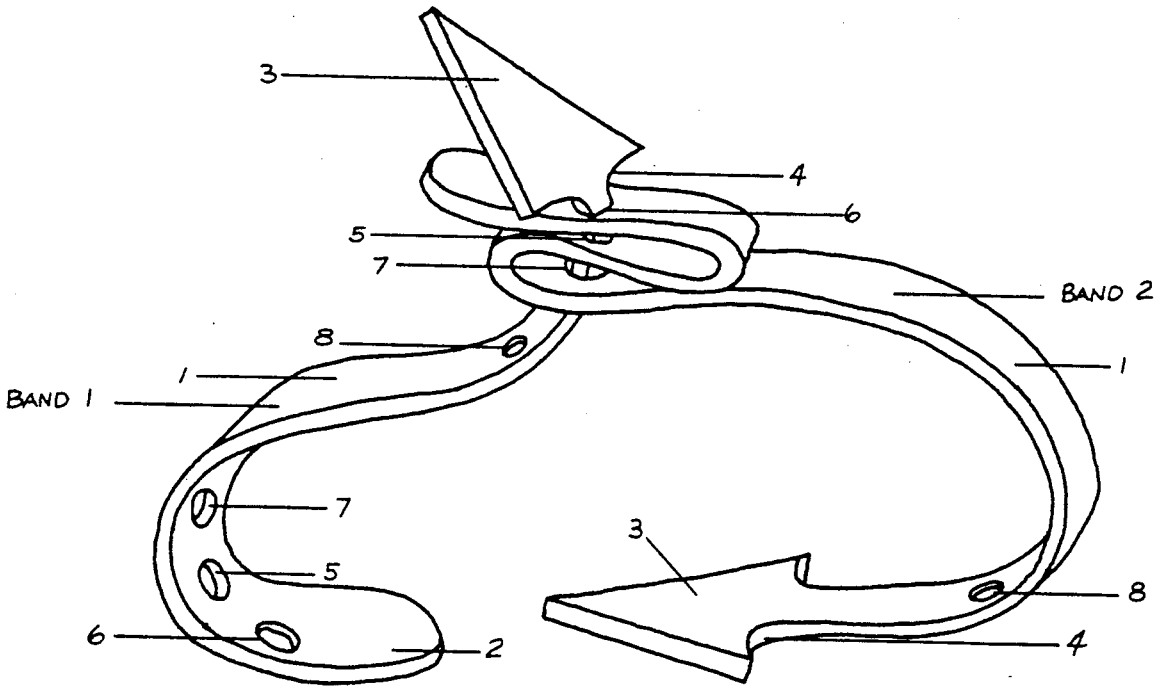
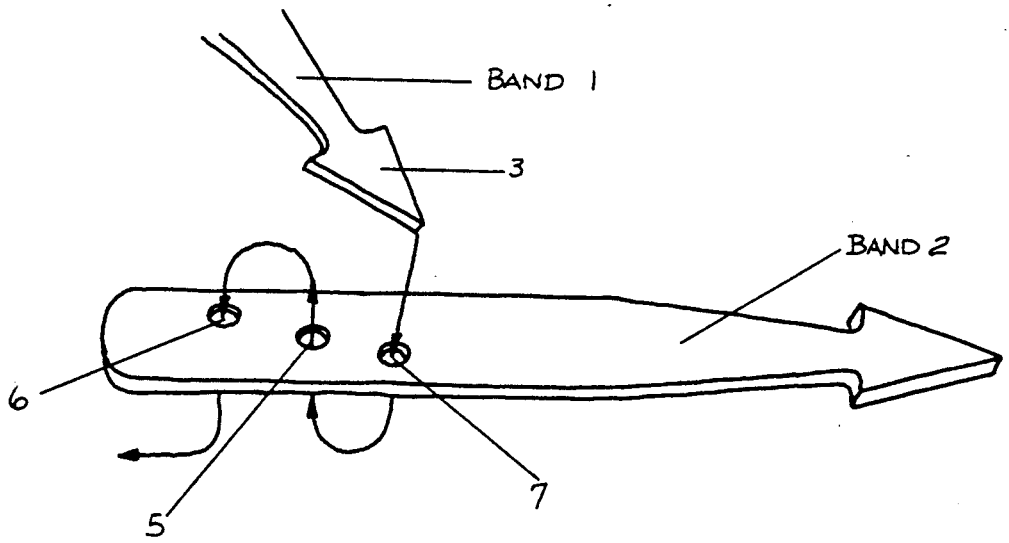
FIG. 6

REUSEABLE, MULTI-PURPOSE, EASY RELEASE PRESSURE BAND

This invention generally relates to securing bands. More specifically, this invention relates to an elasticized, self-fastening and force adjustable band available for use in a variety of applications.

BACKGROUND OF THE INVENTION

Securing objects together have been accomplished by a variety of means including: ties and straps, ropes, adhesives, hardware, etc. These have been expensive and have lacked simplicity, versalitity and adjustability as to number of wraps applied about a bundle of items.

SUMMARY OF THE INVENTION

An object of the invention is to overcome the abovementioned disadvantages by providing a simple, inexpensive, one-piece elastic band of a construction to provide a means of securing anything from household cord and wires to industrial cable; from garden hose to wood. The elastic material allows the device to secure most materials without damaging the surface or shape of those materials. The elastic band has an arrow shape at one end terminating in a neck portion, and a plurality of longitudinally offset holes at the other end.

BRIEF DESCRIPTION OF THE DRAWING

FIGS. 5 and 6 show two bands may be connected end-to-end;

DESCRIPTION OF THE PREFERRED EMBODIMENTS

Figure 1:
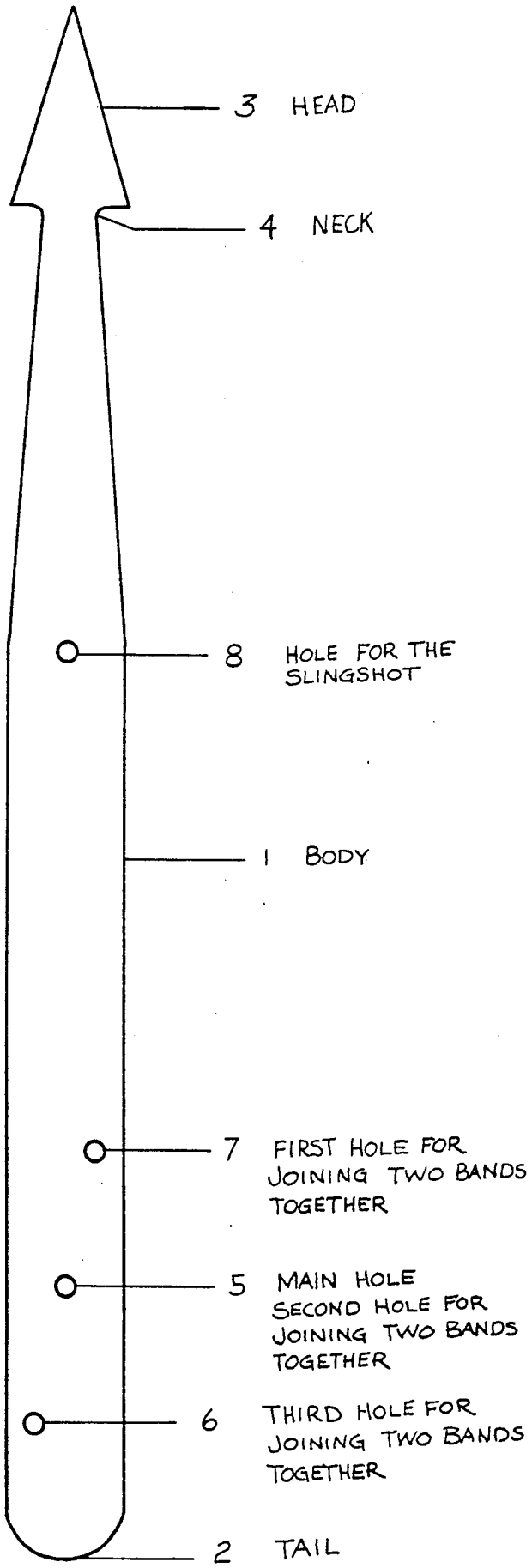
FIG. 1 is a plan view of a multi-purpose elastic band embodying the invention.

FIG. 1 is a plan view of a reuseable, multi-purpose, easy release pressure band, embodying the present invention.

Numeral 1 denotes a flat body of band made of elastic material, such as rubber, having a curved tail 2, an arrow shaped head 3 terminating in a locking neck 4 and a plurality of longitudinally offset holes 5, 6 and 7.

The hole 5 is used for securing band and is the second hole used when joining two bands together. The third hole 6 is used for joining two bands together. The first hole 7 is used for joining two bands together. The hole 8 is used for making slingshots when used as survival gear or for other applications requiring a tie at both ends of the band.

A suitable dimension of the band is one about 17" long, 1 inch wide at the center and 1/16" thick. However, it can be of any other dimensions depending on the application and the required strength.

Figure 2:
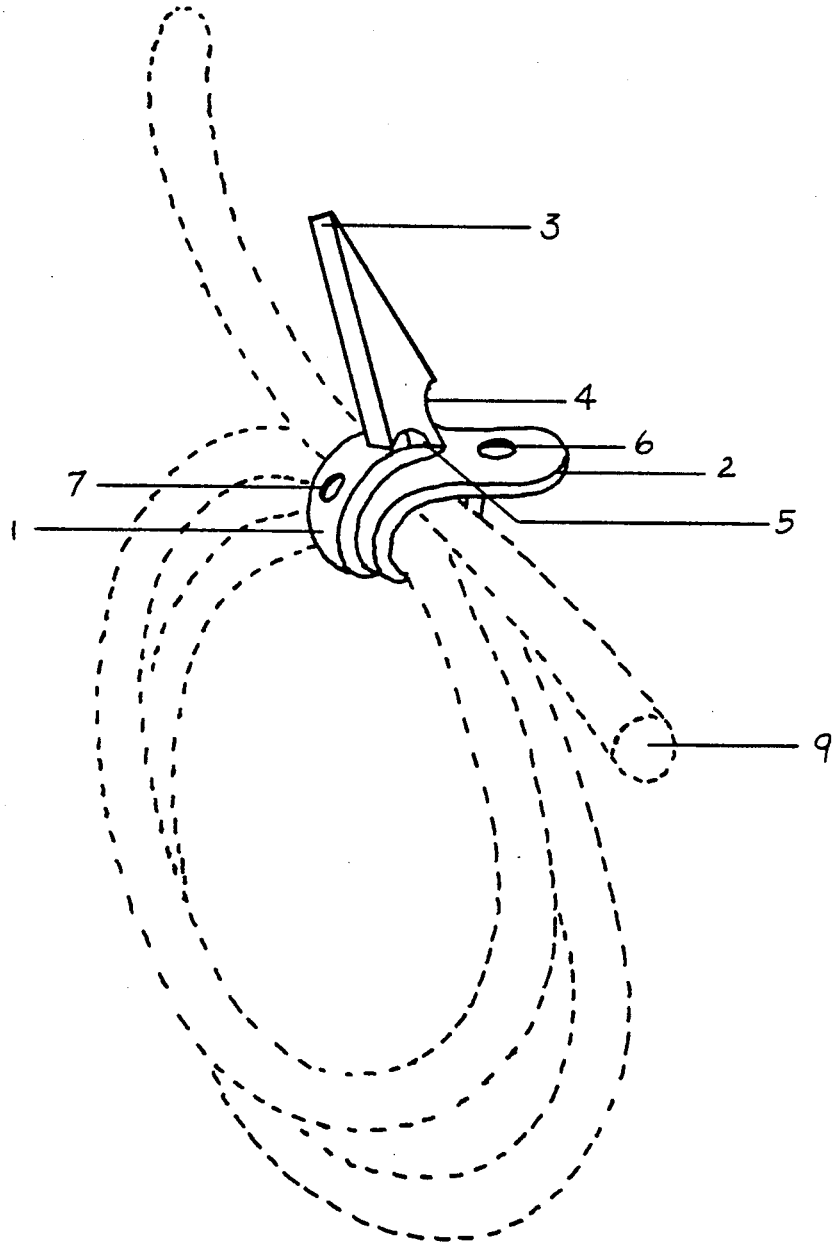
FIG. 2 is a perspective view of the band wrapped about an extension cord or garden hose.

FIG. 2 shows how to secure an extension cord, garden hose or any article of this type. The band is placed behind extension cord 9 shown in dotted outline, the piece to be secured. Holding the band by the tail 2 with the head 3 hanging down, still holding the tail 2, bring head 3 around the piece 9 to be secured and up to hole 5 and insert the head 3 through the hole 5 and pull the whole band through hole 5 until tight. Continue pulling the head 3 around in the same direction, overlapping the band. Bring the head 3 up to hole 5, pulling the tail 2 up which will open hole 5 so that the head 3 will pass through hole 5. Pull through until the neck 4 is through hole 5 then release the tail 2 and the band will secure. To release the band the tail is lifted up and the head is pulled back through hole 5, releasing the band completely. The band used in this way is only for holding articles together that have little or no pressure on them. The band is placed behind piece 9, the piece to be secured. With head 3 hanging down, head 3 is brought up from the front of piece 9 and inserted into center hole 5 and pulled until the whole band is through hole 5 and tight. Continue wrapping and pulling the band around piece 9. The more wraps and the amount of pull on each turn determines the amount of securing pressure. After this is determined, bring head 3 up to hole 5, pull up on tail 2 of the band, which will open the hole 5, and insert head 3 through hole 5 until neck 4 is through hole 5. Release tail 2 and hole 5 will close on the neck 4 and secure the band.

Figure 3:
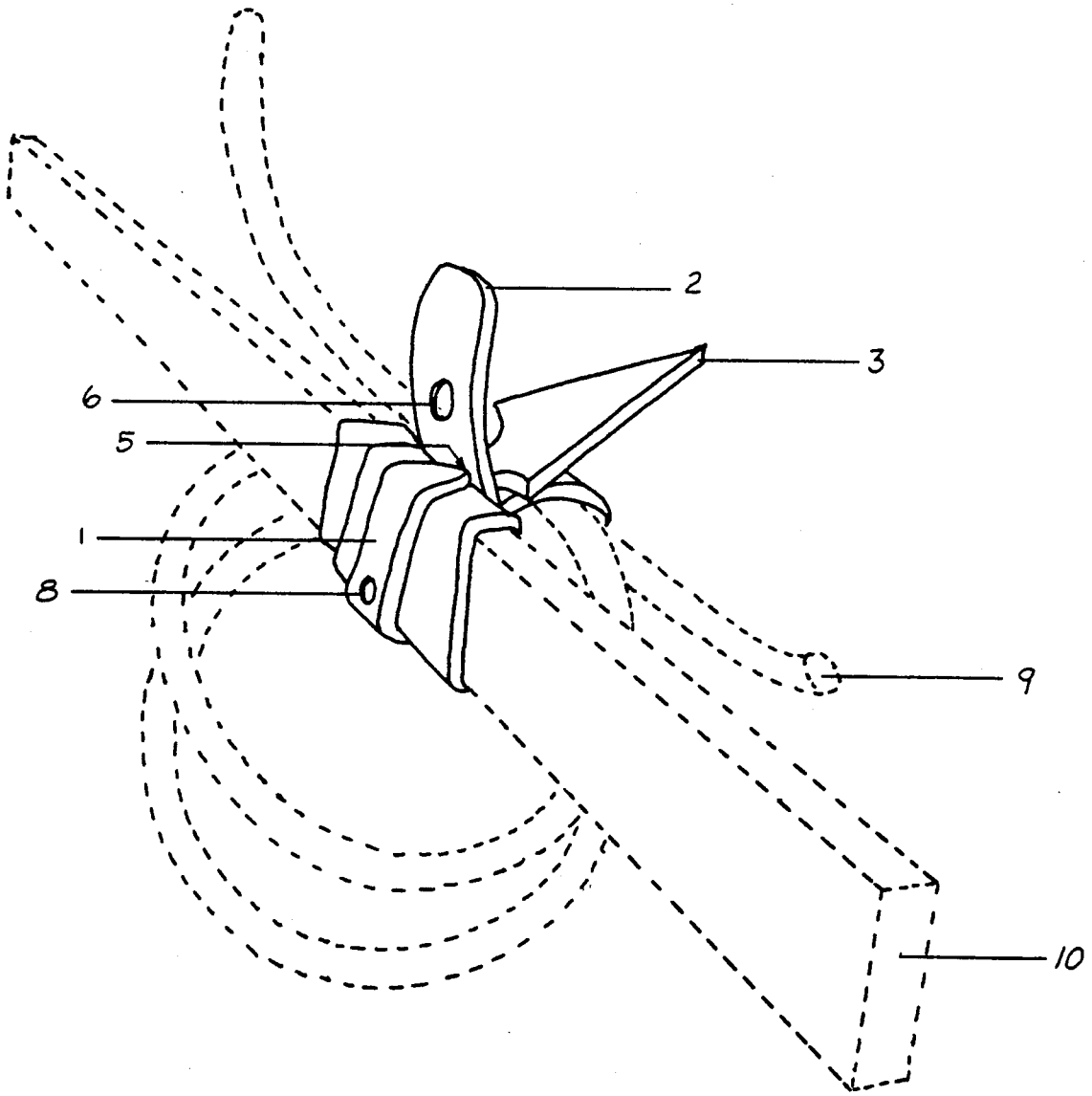
FIG. 3 is a perspective view of the band for supporting a heavy cable.

FIG. 3 shows one use of a multi-purpose band, wherein the band as used achieves its greatest securing power. The band is used for holding and securing large and heavy cable or wire by itself or to an overhead support wire or cable, such as power lines, telephone cable or television cable.

In operation, place band 1 behind support 10 (shown in dotted lines). Then standing overhead wire, cable or support, holding the band by the tail 2, with the head 3 hanging down, bring the head forward and up to hole 5 and insert arrow shaped head 3 through hole 5 and pull the whole band through hole 5 until tight, then take heavy wire or cable and hold it against the band where it's secured to support 10 the standing overhead wire, cable or support. Take the band and bring it forward, encircling the heavy wire or cable, and place it over the standing overhead wire, cable or support. Once the band is over, it can be pulled and stretched down and encircle the heavy wire or cable again and again, each wrap increasing the holding and securing power of the band. The stretching of the elesticized band material acting as a constricting force, and the friction of the elasticized material working against itself make it so. There is very little pressure on the tail 2 or the head 3, at this point, making it easy to add additional bands if necessary. If no more bands are to be added, the head 3 can be brought up from the front to hole 5. While lifting the tail 2, hole 5 will open so that the head 3 can be inserted into hole 5 and pulled through until the neck 4 is through hole 5. With the release of the tail 2, the band will secure. To release the band, lift the tail 2 and pull the head 3 back through hole 5. This will then release pressure and the band can be unwound. The band is made of an elasticized material, such as rubber, neoprene etc., that has no electrically conductive properties and is ideal for use in securing electrical cables without fear of shock or chafing.

Figure 4:
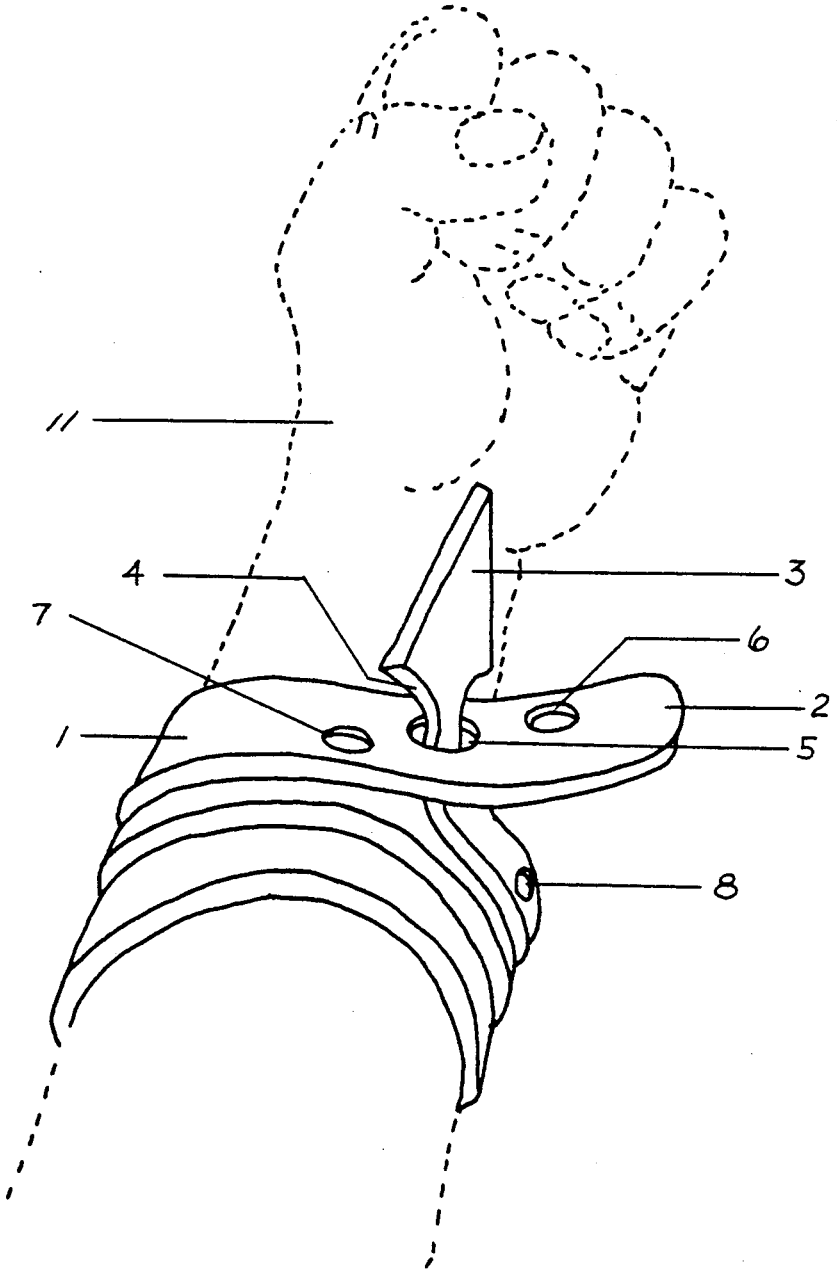
FIG. 4 is a perspective view of the band used as a tourniquet.

FIG. 4 shows the band used as a tourniquet. The band is held by the tail 2 behind the limb that it is to be used on. Still holding the tail 2, the band is then pulled and stretched by the head 3 around the limb, using the amount pulled and stretched on the band to stop the bleeding. At this point, the head 3 is inserted into the hole 5 and pulled until the neck 4 is through hole 5, at which point the band is secured. When pressure is to be released or the band is to be removed, the tail 2 is pulled up and the head 3 is pulled back through hole 5, releasing the pressure.

FIGS. 5 and 6 show how two bands (Band 1 and Band 2) may be connected end-to-end to double the length. To join two bands together to head 3 of "Band 1", the band already secured is inserted into hole 7 of the band 2 from the top or bottom and pulled through until enough of the band can be used to proceed to hole 5. If head 3 is started from the top in hole 7, the head will be inserted from the bottom of the band into hole 5 and pulled through until enough of the band can be used to proceed to hole 6, whereupon the head 3 will be inserted from the top into hole 6 and pulled through until the neck 4 has passes through hole 6 completely. "Band 2" is then pulled by the tail 2. At this time, the bands will be secured with a slight twisting motion and any slack in the joint will be removed by the pulling motion. Joining of the bands can be done before using if one band is not long enough to do the job required or it can be added if it is discovered that an additional band is required. It can be added without the first band losing any of its holding or securing power because the pressure on the head and tail are very little. The holding and securing pressures are produced by the body 1 and number of wraps used with the band. To take bands apart, reverse this procedure.

Figure 7:
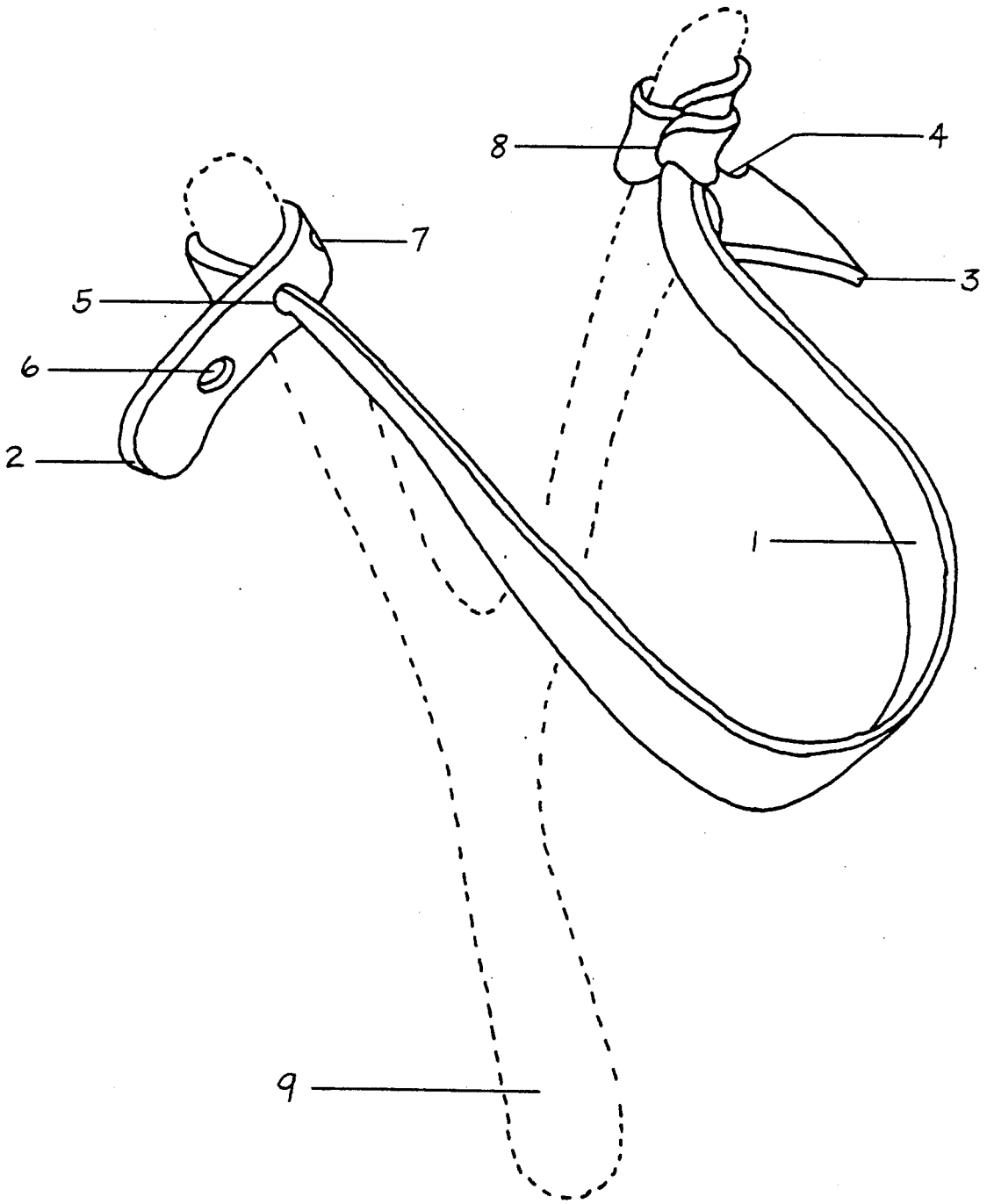
FIG. 7 shows how the band may be connected at their ends to a slingshot.

FIG. 7 shows how to use the band as a slingshot 9 (shown in dotted outline) for use in a survival kit. Insert head 3 into hole 5 and pull the whole band through until it is tight against one arm of slingshot 9. The band is then taken over to the other arm of slingshot 9 and the head 3 is then inserted into hole 8 and pulled tight. The head 3 is then pulled over the top of the band, at this time, and with pulling pressure on the band to open hole 8, the head 3 is then pulled down to the bottom of the band, taken under the band and brought up from the back and inserted into hole 8 and pulled through until the neck 4 is through the hole. Pulling pressure is then released and the slingshot is complete.

Figure 8:
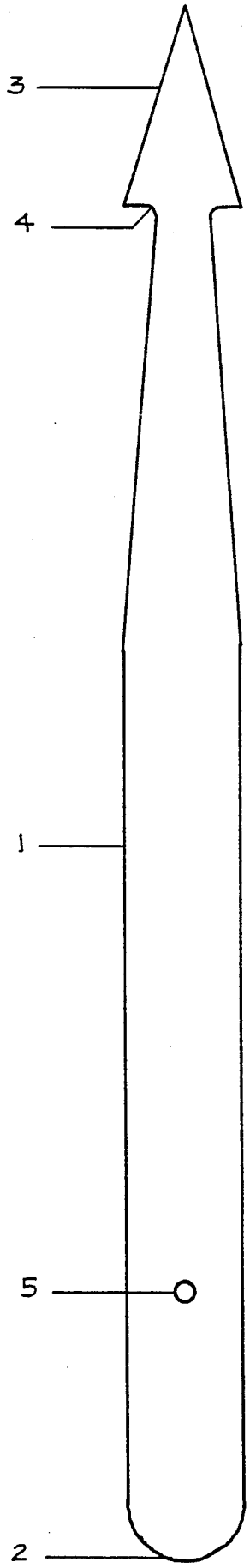
FIG. 8 is a plan view of the band in its simplest form.

FIG. 8 shows the band in its simplest form having a single hole to wrap around an object.

Figure 9:
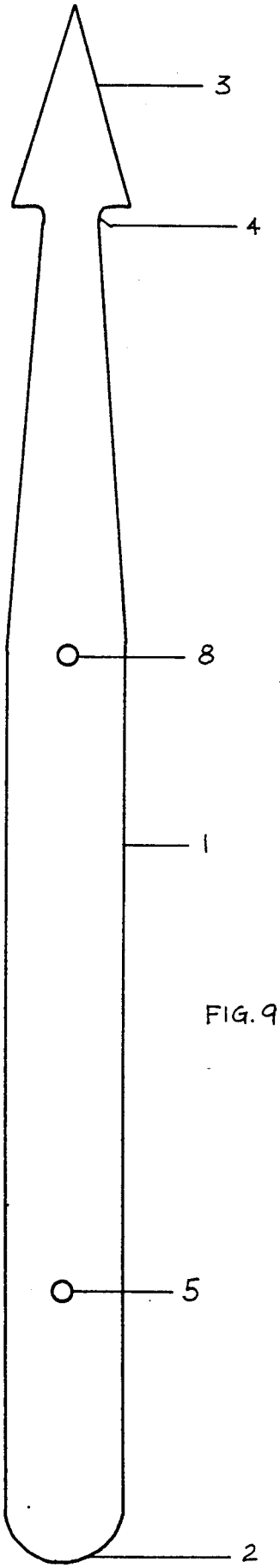
FIG. 9 is a modification of FIG. 8 to make the band also useful as a slingshot.

FIG. 9 shows the band of FIG. 8 with an additional hole near the arrowed end for use also as a slingshot, as in FIG. 7.

The longitudinal arrangement of the three holes 5, 6 and 7 in FIG. 1 is essential to prevent loosening of the band when the band ends are pulled apart.

This invention is unique in that the design, combined with the elastic material of construction provide an instantaneous, force adjustable (amount of pull and number of wraps) securing device which can be easily fastened, released, or lengthened, even under pressure, without disturbing the securing forces of the band itself.

The band may be of any elastic material, such as rubber material, which may be either smooth, front and back, or horizontally ribbed, front and back, or textured, front and back.

This invention operates in its holding power by frictional forces of the elastic material against itself. The securing forces can be adjusted by altering the number of wraps and tightness (or constrictive forces) of the band.

These forces are found in the central body of the band and are not exerted on either the anchor or securing end of the fastening section. Because of this, the fastening section can easily be joined together or released without affecting the securing force of the band. In addition, bands can be joined together by means of the same fastener, enabling the user to increase band length, even while securing forces are being exerted.

Finally, the elastic properties of the band in conjunction with the easy-release fastener design allows this device to be completely reuseable.

USES

The properties and abilities of this securing device allow it to be used for a variety of household, commercial, industrial, agricultural, and medical applications. The following are only some of these potential applications; to secure appliance cords, extension cords, etc. during use or storage: to secure bundles of wires, cords, cables, etc. to another or to a fixed object such as a pipe or stud; to replace a clamp when holding objects together (example) holding chair rungs together while they are being glued; to be used as a temporary patch for leaking hoses and pipes: to fasten plants to stakes without damaging the plant; to secure items while in transport, for instance, equipment in a truck bed or trunk of a car; and to be used in a survival kit for a variety of applications including: securing a lean-to for outdoor shelter; securing a splint; tourniquette; and slingshot.

While I have illustrated and described several embodiments of my invention, it will be understood that these are by way of illustration only and that various change: and modifications are contemplated in my invention within the scope of the following claims:

I claim:

1. A band for wrapping tightly about an object in self fastened relationship thereto, comprising a flat strip of elastic material having a tail end and an arrow shaped head end terminating in a neck portion, and a hole adjacent said tail end of a size to enable said arrow shaped head to be extended therethrough when said end is stretched longitudinally, together with hole means adjacent said tail end is stretched longitudinally staggered relationship to said hole and of a size through which said arrow shaped head may be extended when said tail end is stretched to enable two bands to be locked together end-to-end, said hole means comprising two holes each of which is longitudinally offset relatively on opposite sides of said hole adjacent said tail end and which are of sufficient size that when said tail end is stretched, the arrow shaped end of a joined band will fit said hole adjacent said tail end as well as said two holes.

2. A band as recited in claim 1 together with a second hole beyond and adjacent said neck portion to allow each end of said band to be securely tied to two projecting ends of an object such as a slingshot.

3. A band as recited in claim 1 made of rubber material.

4. A band as recited in claim 1 wherein said tail end is rounded.

* * * * *